US007193514B2

(12) United States Patent
Ritson

(10) Patent No.: US 7,193,514 B2
(45) Date of Patent: Mar. 20, 2007

(54) CHILD RESISTANT CLOSURE CAP

(76) Inventor: Peter Alvin Ritson, 81A New Ferry Road, New Ferry, Birkenhead, Merseyside (GB) CH62 1BH ( * ) Notice: Subject to any disclaimer, the term of this patent is extended or adjusted under 35 U.S.C. 154(b) by 338 days.

(21) Appl. No.: 10/509,729

(22) PCT Filed: Apr. 4, 2003

(86) PCT No.: PCT/GB03/01469

§ 371 (c)(1),
(2), (4) Date: Sep. 30, 2004

(87) PCT Pub. No.: WO03/086894

PCT Pub. Date: Oct. 23, 2003

(65) Prior Publication Data

US 2005/0199023 A1 Sep. 15, 2005

(30) Foreign Application Priority Data

Apr. 5, 2002 (GB) ..... 0207890.5

(51) Int. Cl.
*G08B 13/08* (2006.01)

(52) U.S. Cl. ..... 340/545.6; 340/5.82; 340/693.2

(58) Field of Classification Search ..... 340/545.6, 340/686.3, 686.1, 693.1, 665, 309.6, 5.82, 340/5.83

See application file for complete search history.

(56) References Cited

U.S. PATENT DOCUMENTS

| | | | | |
|---|---|---|---|---|
| 4,847,597 | A | 7/1989 | Dobosi et al. | |
| 6,545,594 | B1 * | 4/2003 | Knight et al. | 340/384.7 |
| 2005/0110647 | A1 * | 5/2005 | Ritson | 340/686.1 |
| 2006/0145820 | A1 * | 7/2006 | Rosche | 340/309.16 |

FOREIGN PATENT DOCUMENTS

| | | |
|---|---|---|
| WO | WO02/14635 | 2/2002 |

* cited by examiner

*Primary Examiner*—Daniel Wu
*Assistant Examiner*—Travis R. Hunnings
(74) *Attorney, Agent, or Firm*—Shoemaker and Mattare

(57) ABSTRACT

A child resistant closure cap for preventing the inadvertent consumption of pharmaceutical products, bleaches or other products by children or other minors. The child resistant closure cap can be easily removed by adults and elderly persons and uses intrinsic biometric (physical dimension) human attributes to differentiate between adults and children instead of relying on differences in ability. In use, the present invention senses electronically the size of the thumb, forefinger or middle finger, or hand crotch, prior to unlatching the closure cap. The sensors are provided using at least one piezoelectric transducer which performs both functions of detecting the biometric attributes of the user, and by doing so, also generates and stores electrical energy by virtue of the piezoelectric effect.

56 Claims, 6 Drawing Sheets

CHILD RESISTANT CLOSURE CAP

This Application is a national phase of International Application No. PCT/GB03/01469, filed Apr. 4, 2003, to P. A. Ritson, for Child Resistant Closure Cap.

This invention relates to a child resistant closure cap. In particular, the present invention relates to a child resistant closure cap that can be easily removed by adults and elderly persons, and which prevents the inadvertent consumption of prescription medicines or hazardous domestic chemicals by children or other minors.

Within the European Union, nearly 500,000 children were poisoned by prescription drugs in 1998. A further 330,000 children were also poisoned by corrosive or toxic domestic chemicals, in spite of the fact that all of these compounds are obliged under Directive 67/548/EEC to be packaged in containers with childproof caps. The current design of childproof caps, relying on differences in strength, dexterity and cognitive ability, suffers from a particular conundrum: the cap has to resist the efforts of a determined child for 10 minutes, but be easy to open and close within the same time by an elderly person. Since the hand strength and dexterity of a 4-year-old child and a 70-year-old adult are approximately the same, designing a mechanical push and twist closure cap which allows easy access by elderly persons, yet which prevents child access has proved very difficult.

This problem is further compounded by the fact that children are being deliberately trained in motor skills at younger and younger ages by complex new toys, and so their capability for opening ever more complex closure caps is growing. In addition, the elderly patient who finds the closure cap difficult to open will simply leave the cap off. These two factors have led to a growth in the accident figures of roughly 5% per year, further exacerbated by the increase in three-generation homes.

Traditional child resistant closure caps all utilise a specific generic differentiator between children and adults to act as the 'key' to unlocking the opening mechanism. The key to the effectiveness of the childproofing lies in the degree of differentiation that is provided, and how that can be connected to the opening mechanism. There are a number of well known techniques which have been utilised to detect the degree of differentiation, which firstly include the mechanical push and twist closure caps which only operate through a combination of strength and dexterity. Children's hands are incompletely developed until the age of 12 to 15 years and, in particular, the group of bones and cartilage at the base of the wrist (carpal bones) and the bone ends (epiphysis) are absent. This leads to a significantly lower degree of strength and dexterity in children, and push and twist closure caps have proven popular. However, whilst these closure caps are relatively cheap and effective, they can be overcome eventually by combinations of levering, biting and the like, if the child is determined. In addition, their complexity and operating torque frequently defeat adults, and particularly elderly persons, whose strength and dexterity can be the same as a 4-year-old child.

Other prior art techniques include complex 'trap door' lever and maze types of closure cap, which rely more on ingenuity and precision. They suffer from the problem that they are more difficult and challenging for adults as well as children, and the rise of motor skill improving toys has recently provided a good basic training for infants in learning to overcome these devices more easily.

A number of closure caps have also been developed which are simple to operate with a key or code access. These have the advantage of being impossible to open without the key or code, and easy to open with it. However, they do not 'fail safe', in that once the infant has the key or code it can easily get at the contents of the container.

It is the object of the present invention to provide a child resilient closure cap that can be easily removed by adults and elderly persons, and which prevents the inadvertent consumption of prescription medicines or hazardous domestic chemicals by children or other minors. The present invention uses intrinsic biometric (physical dimension) human attributes to differentiate between adults and children instead of relying on differences in ability. In particular, it is an object of the present invention to provide a child resilient closure cap which senses electronically the size of the thumb, forefinger and middle finger, or hand crotch, prior to unlatching the closure cap.

According to the present invention there is provided a child resistant closure cap for a container, said cap including:

an electrical generation means for generating and storing electrical energy;

at least one sensing means, being energised by said electrical generation means, for detecting the biometric attributes of a user attempting to remove said cap; and a latching means operable by said at least one sensing means, for releasably securing said child resistant closure cap to a container, in use.

In use, said cap is adapted to engage with said container via a screw thread. Preferably, said cap being formed from polypropylene or molded from a suitable plastics material. Further, in use, said cap having physical dimensions compatible with standard containers of prescription medicines, hazardous domestic chemicals or other products.

In a preferred embodiment, said electrical generation means is capable of powering said at least one sensing means for detecting the biometric attributes of a user attempting to remove said child resistant cap, and if the biometric attributes are found to match those of an adult, the latching means is opened to allow user access. Preferably, said electrical generation means further comprises a piezoelectric element for converting mechanical energy expended by said user into electrical energy. Said piezoelectric element being formed from a suitable piezoceramic material or polyvinylidene fluoride film. In one embodiment, said at least one sensing means is provided using at least one piezoelectric transducer which performs both functions of detecting the biometric attributes of said user, and by doing so, also generates and stores electrical energy by virtue of the piezoelectric effect.

Preferably, in order to increase the output voltage produced by said piezoelectric element, said electrical generation means may further include a ratchet-type mechanism for producing a repeatable dynamic force on said piezoelectric element, prior to the user attempting to remove the child resistant cap from said container. In use, the piezoelectric element may be located on a substrate or support plate which can turn freely within the child resistant cap. Prior to the user attempting to place his thumb and fingers near to said at least one sensing means, he rotates a knob mounted on top of the cap which, in turn, rotates the support plate having the piezoelectric element located thereon. As the support plate turns, it meets with a number of deflection nodules located at regular intervals inside the periphery of the cap, causing said support plate to be repeatedly flexed and deformed, which produces a large, regular dynamic force on said piezoelectric element which, in turn, generates a much larger electrical output.

In an alternative embodiment, said electrical generation means may further comprise a flexible piezoelectric element mounted on a support plate, which is located inside a two-part child resistant cap. With such two-part cap, the user must align both sections of the cap prior to said at least one sensing means detecting the biometric attributes of said user. In use, one end of the flexible piezoelectric element and support plate is fixed in one section of the cap; the other end of the piezoelectric element and support plate fixed in a second movable section of the cap. As the user attempts to align both sections of the cap, the flexible piezoelectric element is flexed and distorted which produces a large electrical output.

In a further alternative embodiment, said electrical generation means further comprises a self-winding mechanism, whereby the action involved in releasing and replacing said cap may provide sufficient electrical energy. The work involved in the rotation of motion being released every time the container is handled and which can be harnessed using a self-winding mechanism.

In an alternative embodiment, said electrical generation means further comprises an electromechanical generator. In use, a mechanism is provided which gives sufficient motion of a moveable coil linking a fixed magnetic field to produce said electrical energy. Further, in use, said electrical generation means may also include a plurality of photovoltaic cells for converting light energy into electrical energy.

In a preferred embodiment, said at least one sensing means further comprises a number of sensors mounted on and around said child resistant cap for detecting the biometric attributes of the hand and fingers of the user attempting to remove said child resistant cap. Said biometric attributes may include finger length or finger thickness, or any human dimensions that change with age. In use, the physical position of the sensors is such that a child or other minor would not be able to position his hand and fingers on all sensors simultaneously to operate the latching means.

Preferably, in use, said at least one sensing means further comprises at least one pressure transducer which can be implemented using at least one piezoelectric transducer. In use, said at least one piezoelectric transducer would also perform the function of said electrical generation means and would, preferably be located on the same substrate as said electrical generation means. In use, a substrate containing an array of piezoelectric transducers along with a surface storage capacitor would form an integral biometric sensor and electrical generation means, and which could store and release sufficient electrical energy to operate the latching means.

In use, said at least one sensing means may also comprise a resistance or capacitance sensor. Alternatively, a proximity sensor could also be incorporated to determine, for example, the distance between the top of the cap and the hand crotch of the user.

Further, in use, said latching means only allows user access to the contents of said container after verification by said at least one sensing means. The latching means comprises a spring-loaded pin which extends inwards inside the periphery of the cap. In an open condition, the pin is retained inside the cap by the use of electromagnetic solenoid or piezoelectric actuator. In a locked position, the pin extends outwards into an aperture located on the container. The latching means will always 'fail-safe' as, in the absence of an electrical signal to the actuator, the spring-loaded pin is forced in aperture, and the cap cannot be removed.

In an alternative embodiment, said latching means is incorporated inside a two-part child resistant cap, and further comprises a mechanism which extends between inner and outer parts of the two-part cap. In a locked position, the mechanism is such that the outer part of the cap does not cooperate with the inner part of the cap which, in turn, is engaged to the screw thread on the container. As such, the outer part of the cap turns freely and the cap cannot be unscrewed from the container. In an unlocked condition, the mechanism is such that the inner and outer parts of the cap cooperate with each other, and the user can easily remove the cap from the container.

In use, an audible sounder may also be included to warn that an unauthorised access by a child has been attempted. If an unsuccessful attempt to remove the cap is made by a child, the electrical generation means activates an audible sounder to warn an adult on the premises that the container has been tampered with. In use, said audible sounder may be provided by an electromagnetic or piezoelectric sounder, although to reduce energy requirements the latter is preferred.

Also according to the present invention there is provided a child resistant closure cap which, in use, is adapted to engage with a container, comprising:

at least one piezoelectric transducer for detecting the biometric attributes of a user attempting to remove said child resistant cap from said container, and thereby generating an electrical output; and a latching means, being in connection with at least one piezoelectric transducer, for releasably securing said child resistant cap to said container.

The advantages of the present invention are that a child resilient closure cap is provided that can be easily removed by adults and elderly persons, and which prevents the inadvertent consumption of prescription medicines or hazardous domestic chemicals by children or other minors. The present invention uses intrinsic biometric (physical dimension) human attributes to differentiate between adults and children instead of relying on differences in ability. In particular, a child resilient closure cap is provided which senses electronically the size of the thumb, forefinger and middle finger, or hand crotch, prior to unlatching the closure cap.

It will be obvious to those skilled in the art that variations of the present invention are possible and it is intended that the present invention may be used other than as specifically described herein.

A specific non-limiting embodiment of the invention will be described by way of example and with reference to the accompanying drawings in which.

Figure 9:
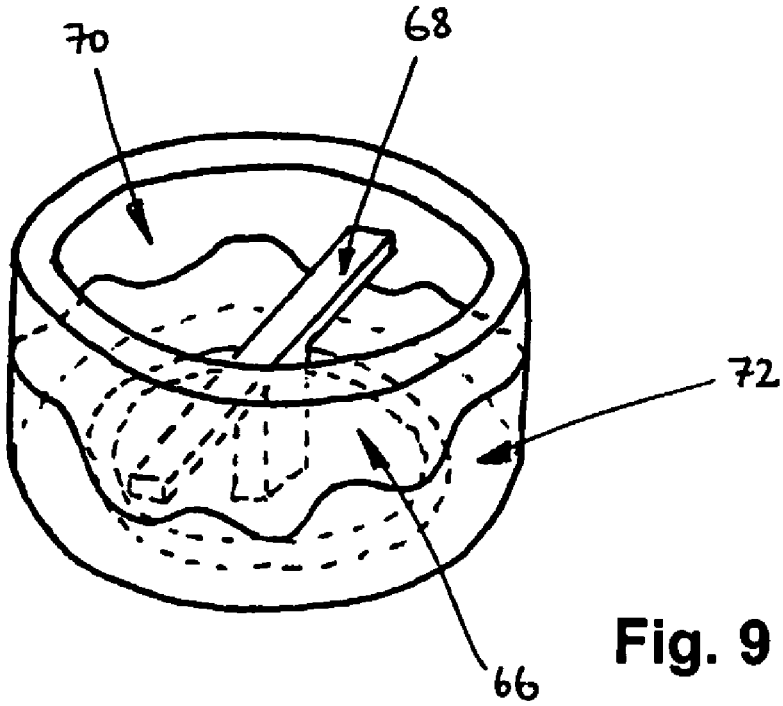
FIG. 9 is perspective view of an alternative apparatus of generating electrical power inside the closure cap.
Figure 11:
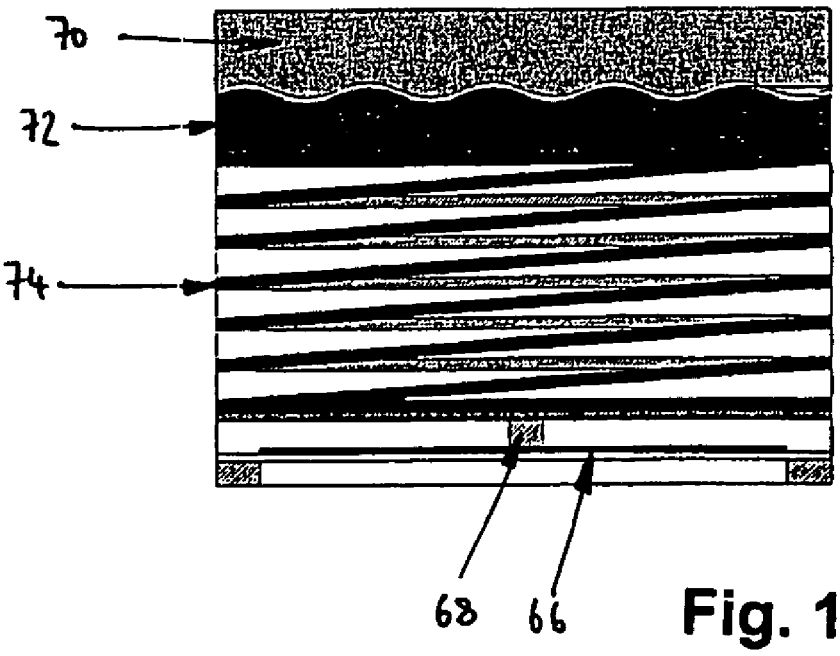

FIG. 11 details a further embodiment of the apparatus of FIG. 9.

Figure 1:
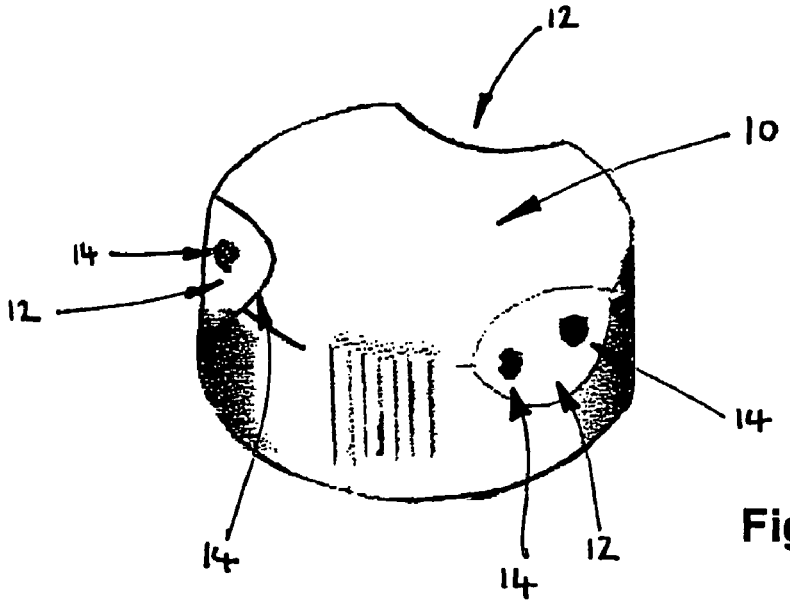
FIG. 1 shows a child resistant closure cap according to the present invention.

Referring now to the drawings, a child resistant closure cap according to the present invention is illustrated in FIG. 1. In use, the child resistant closure cap 10 is screwed on to any standard container capable of storing prescription medicines, bleaches or any other products that could be poisonous or otherwise dangerous if inadvertently consumed by children or other minors. The closure cap 10 being formed from polypropylene or moulded from a suitable plastics material.

In use, when attempting to remove the cap 10, a user simply places his fingers into the three slotted recesses 12 that are provided around the periphery of the cap 10. Inside each of the recesses 12, a number of sensors 14 detect the width of the thumb, forefinger and middle finger. The spacing between the recesses is such that only an adult's hand can unlock the latching mechanism inside the cap 10 to access the contents of the container.

To generate sufficient electrical power to activate the latching mechanism, a number of techniques may be utilised. In the embodiment shown in FIG. 1, each of the sensors 14 inside the recesses 12 comprises a piezoelectric pressure transducer. In use, these piezoelectric pressure transducers perform the function of sensing the width of the thumb and fingers of the user, and by doing so, an electrical output will be generated by virtue of the piezoelectric effect. In particular, as each piezoelectric pressure transducer is mechanically deformed by the thumb or fingers, an electrical output will be generated across the face of the piezoelectric pressure transducer which is conditioned and stored prior to operating the latching mechanism inside the cap. In use, a single substrate is provided containing an array of piezoelectric pressure transducers and at least one surface storage capacitor, to form an integral biometric sensor and electrical generation means which can store and release the energy to drive the latching mechanism.

A piezoelectric pressure transducer, as described above, does suffer one main disadvantage in that it could possibly be deceived into operating the latching mechanism by placing an appropriately sized non-organic object into each of the recesses 12. In order to overcome this, sensors 12 could be implemented using resistance or capacitance sensors which both detect the size of the thumb or finger along with the resistance or capacitance of such. Resistance sensors can be produced using copper meshing and will detect the contact area placed upon them, and which has the advantage of being low power and less likely to be fooled by non-organic objects. However, the bodies' resistance does vary with perspiration, temperature and age, and this would need to be compensated for in the signal conditioning electronics.

Alternatively, the sensors 12 may be implemented using conductivity sensors to validate that the thumb and fingers placed in the recesses are adult-sized. However, it will be necessary to calibrate the sensors each time the user attempts to remove the child resistant cap as every person has a slightly different conductivity, which is again is dependent on body temperature, perspiration levels and circulation etc. As such, calibration sensors are located around the centre of the cap, which have to be touched prior to placing the thumb and fingers in the recesses to be detected by the sensors. In use, a microprocessor is used to sequence through the conductivity sensors located in the recesses to firstly determine which sensors have been touched. The microprocessor then determines if the resultant signals obtained match those of an adult. In use, a matrix array of such sensor pads are located in the recesses that are provided around the periphery of the cap.

Figure 3:
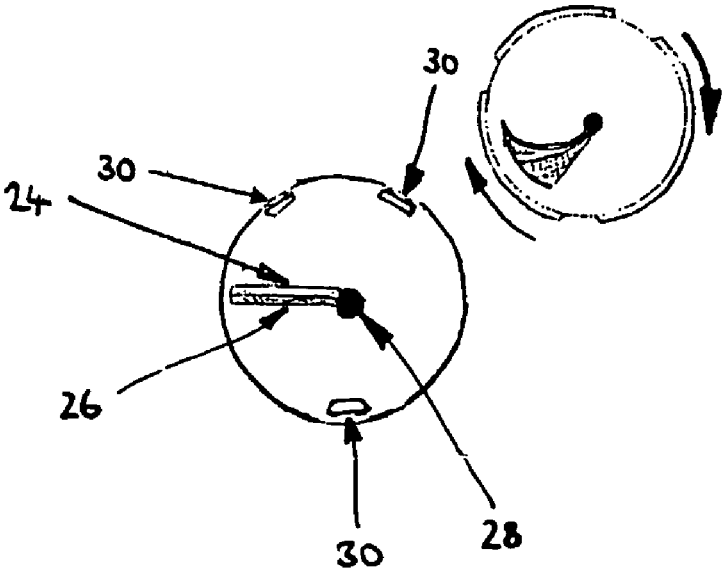
FIG. 3 illustrates an alternative method of generating electrical power inside the closure cap.

If the present invention is implemented using resistance, capacitance or conductivity sensors (which are not self-powered) then alternative methods of generating electrical power will be utilised. In particular, the present invention may be implemented using a two-part part closure cap, whereby both sections of the cap have to be aligned prior to placing the thumb and fingers in the recesses, and detected by the sensors. In this way, since mechanical energy is expended by the user on rotating and aligning both sections of the cap, such mechanical energy can be readily converted in electrical energy using an electrical generation means which further comprises a piezoelectric element. In use, a flexible piezoelectric element is mounted to a suitable substrate which is fixed in one section of the cap; the other end of the piezoelectric element being fixed in the second section part of the cap. As the user attempts to align both parts of the cap, the flexible piezoelectric element is flexed and distorted which will produce a large electrical output capable of powering both the sensors and the latching mechanism. Further details of such a flexible piezoelectric element are illustrated in FIG. 3.

Figure 4:
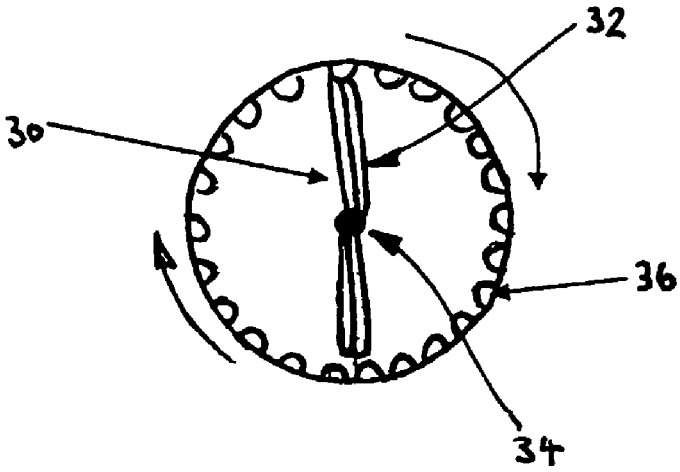
FIG. 4 shows further detail of a ratchet-type mechanism which may be utilised to power the closure cap.

A further technique for generating a suitable electrical output could be implemented on the closure cap shown in FIG. 1, having a ratchet-type mechanism mounted on top of the cap. In use, the user simply rotates the ratchet mechanism, which consists of a movable piezoelectric element, several times prior to placing his thumb and fingers into the recesses. Further details of this ratchet mechanism are shown in FIG. 4.

A suitable piezoelectric material which may be used for the electrical generation means, and also the piezoelectric pressure transducers, is polyvinylidene fluoride (PVDF) which is an engineering plastic approved for food contact, and which exhibits piezoelectric behavior. The PVDF film is typically extruded using a blown film technique or from a slot die. When melt-extruded form II PVDF sheet is uniaxially stretched with draw ratios of 3–5:1 at a temperature up to 150° C., the material recrystallises predominantly as form I polymorph (required for piezoelectric effect). Drawn PVDF consist of parallel crystalline, folded lamellae within the amorphous phase and between which are less ordered polymer chains. After stretching, dipoles in the crystalline region are still fairly randomly orientated and poling by the means of a high electric field is required to give effective levels of piezoelectric response. The high internal field in the film volume created by the charge build up on the surface aligns the dipoles in form I and also results in the conversion of form II to form I. Piezoelectric effects being doubled when corona poling and stretching are performed simultaneously.

Figure 2:
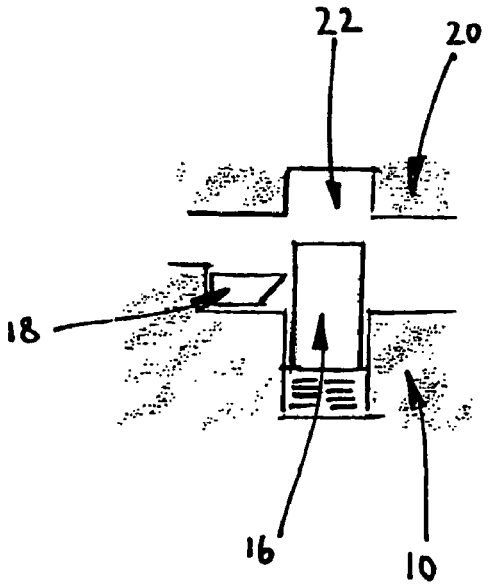
FIG. 2 illustrates detail of the latching mechanism between the closure cap and the container.

Such a piezoelectric material described above may also be utilised as part of the latching mechanism depicted in FIG. 2. In use, if the sensors located around the periphery of the cap validate that the thumb and fingers placed in the recesses are adult-sized, then a signal will be passed to open the latching mechanism and the user can remove the closure cap. The latching mechanism shown in FIG. 2 comprises a spring-loaded pin 16 which extends inwards inside the periphery of the cap 10. In an open condition, the pin 16 is retained inside the cap 10 by the use of electromagnetic solenoid or piezoelectric actuator 18. In a locked position, the pin 16 extends outwards into aperture 22 located on the container 20. In use, a number of these latching mechanisms may be located inside the cap, so that the cap is resistant to physical abuse, particularly shearing. The latching mechanism will always 'fail-safe' as, in the absence of an electrical signal to the actuator 18, the spring-loaded pin 16 is forced in aperture 22, and the cap cannot be removed.

Figure 5:
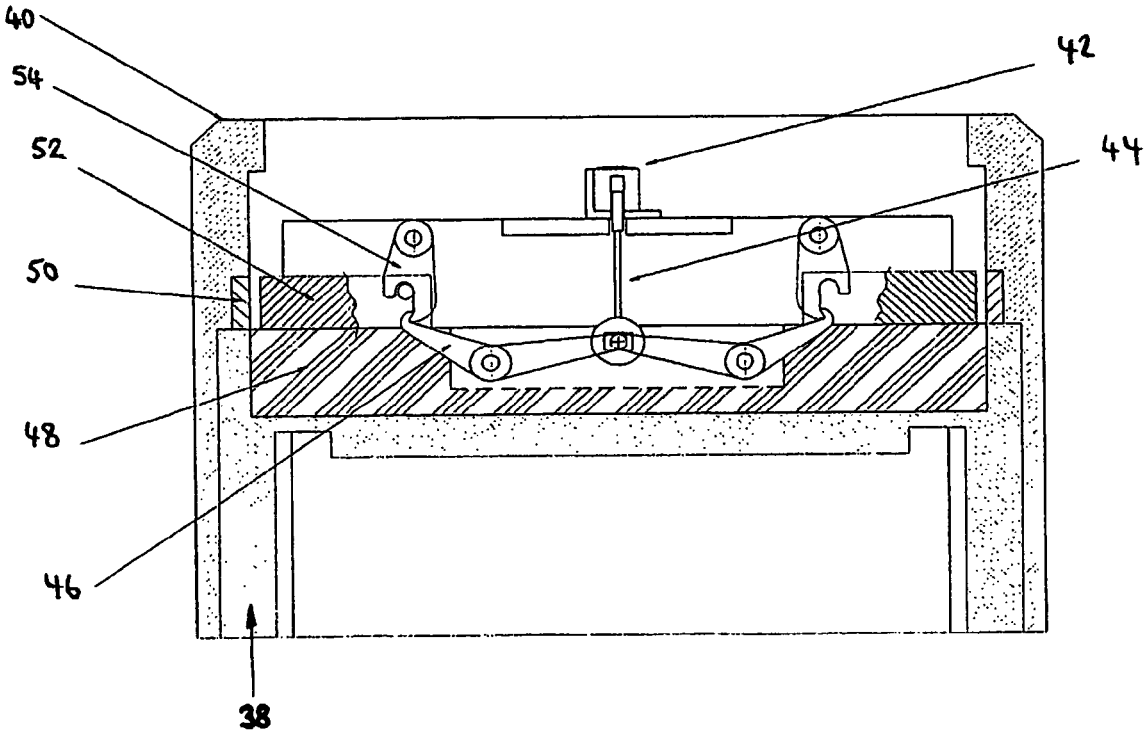
FIG. 5 is a side view of a further latching mechanism between the closure cap and the container according to the present invention.

Detail of the implementation of an alternative latching mechanism according to the present invention is shown in FIG. 5. The latching mechanism shown in FIG. 5 extends between the inner 38 and outer sleeve 40 of a two-part closure cap, located in a cradle 48. In use, if the sensors (not shown) located around the periphery of the outer sleeve 40 of the cap validate that the thumb and fingers placed in the recesses are adult-sized, then a signal will be passed to open the latching mechanism. This signal is passed to an electromagnetic solenoid 42, which raises an actuating pin 44. The action of raising actuating pin 44 also raises pivoted release levers 46. Spring-loaded arms 52 are then released, via levers 54, to engage with the ratchet 50 in the outer sleeve 40, such that the inner 38 and outer sleeve 40 of the closure cap cooperate with each other. The cap can then be unscrewed from the container via the screw thread (not shown) located inside the periphery of inner sleeve 38. Plan views of this latching mechanism with the spring-loaded arms 52 engaged and released are shown in FIGS. 6 and 7, respectively.

Figure 6:
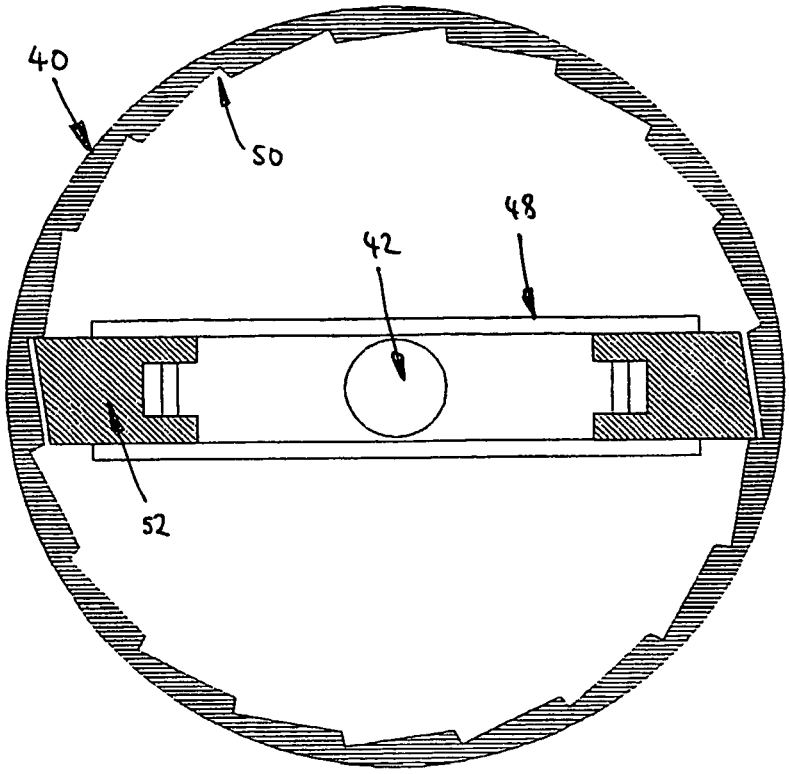
FIG. 6 is plan view showing further detail of how the latching mechanism of FIG. 5 is engaged.
Figure 7:
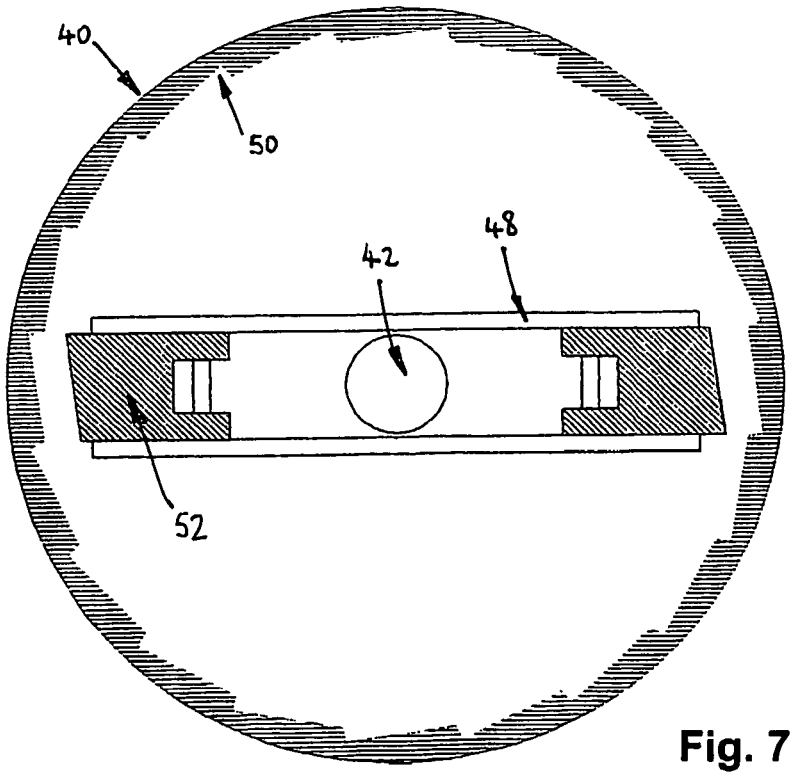
FIG. 7 is plan view showing further detail of how the latching mechanism of FIG. 5 is released.

To reset the latching mechanism according to FIGS. 5 to 7, the user simply screws on the closure cap onto the container. The spring-loaded arms 52 are drawn in and recaptured by actuating pin 44. In further alternative embodiments, it is envisaged that a cammed latching mechanism is utilised to engage the inner and outer sleeves of the closure cap, or alternately, a clutch release mechanism is provided to engage the inner and outer sleeves of the cap.

In use, the present invention may also include an audible sounder so that if, for any reason, a child does gain access to the contents of the container, an audible alarm is sounded. Additionally, if an unsuccessful attempt to remove the cap is made by a child, the electrical generation means activates the audible sounder to warn an adult on the premises that the container has been tampered with. In use, the audible sounder may be provided by an electromagnetic or piezoelectric sounder, although to reduce energy requirements the latter is preferred.

FIG. 3 shows further detail of how a flexible piezoelectric element can be mounted inside a two-part closure cap. In particular, a flexible piezoelectric element 24 is mounted onto substrate 26, which may comprise a suitable plastics material or sprung steel plate. One end of the piezoelectric element 24 and substrate 26 is pivotably fixed, via post 28, in the first section of the cap; the other end of the piezoelectric element 24 and substrate 26 being fixed in the second moveable section of the cap. When the user attempts to align both sections of the cap, prior to placing his thumb and fingers on the sensors 30, the flexible piezoelectric element 24 is flexed and distorted which produces an electrical output which is capable of powering the sensors 30 and the latching mechanism.

FIG. 4 shows further detail of an alterative ratchet-type mechanism for generating electrical energy. In use, a piezoelectric element 30 is located on a support plate 32 which can turn freely within the child resistant cap via pivot 34. The user rotates a knob mounted on top of the closure cap (not shown) which, in turn, rotates the piezoelectric element 30 and support plate 32 which meets with a number of deflection nodules 36 located within the periphery of the cap. This causes the piezoelectric element 30 and support plate 32 to be repeatedly flexed which, in turn, generates a large electrical output for powering the sensors and the latching mechanism. In use, the user simply rotates the knob several times to charge up the sensing circuit, prior to placing his thumb and fingers in the recesses around the cap.

Figure 8:
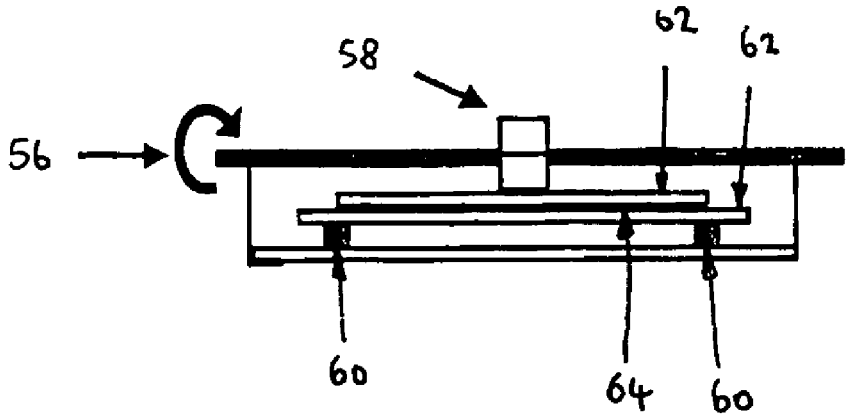
FIG. 8 is a side view showing further detail of an alternative mechanism which may be utilised to power the closure cap.

FIGS. 8 to 11 shows further detail of alterative mechanisms for generating electrical energy using piezoelectric elements according to the present invention. FIG. 8 shows one technique whereby a piezoelectric element 64 is interposed between two sprung steel sections 62 substantially formed as a flat, circular disc. The piezoelectric element 64 and sprung steel sections 62 are located on a number of support elements 60 which positioned at regular intervals inside the closure cap (not shown). Situated above the disc is an axle 56 with a nut 58 located thereon. In use, the user rotates the nut 58 mounted above the disc which, in turn, deflects the piezoelectric element 64 and sprung sections 62. This causes the piezoelectric element 64 and sprung sections 62 to be repeatedly flexed which, in turn, generates a large electrical output for powering the sensors and the latching mechanism.

Figure 10:
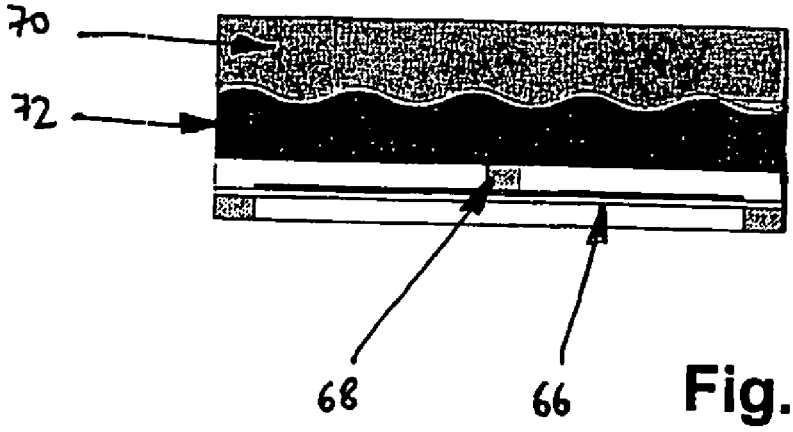
FIG. 10 shows a side view of the apparatus of FIG. 9.

FIGS. 9 and 10 illustrate a further mechanism for generating sufficient electrical energy using piezoelectric elements. With this technique a two-part cap is utilised having an upper part 70 which is free to rotate above a fixed part 72, via an undulating contact surface. Connected to the inner periphery of the upper part of the cap 70 is a substantially T-shaped member 68 which is situated above a piezoelectric element interposed between two sprung steel sections substantially formed as a flat, circular disc 66, similar to that described in FIG. 8. Again, in use, the user rotates the upper part 70 of the cap mounted above the disc 66 which, in turn, deflects the piezoelectric element and sprung sections, via the T-shaped member 68. This causes the piezoelectric element and sprung sections to be repeatedly flexed which, in turn, generates a large electrical output for powering the sensors and the latching mechanism. In order to increase the flexing effect on the piezoelectric element and sprung sections, a further resilient element, such as a spring 74, may be interposed between the T-shaped element 68 and the disc 66, as shown in FIG. 11.

It is also envisaged that a suitable electrical output could be provided using a simple mechanical storage, whereby the actions involved in releasing and replacing the closure cap could provide the source of energy. The work involved in the rotation of motion is released every time the container is handled and may harnessed using a self-winding mechanism, similar to that known with wrist watches. Alternately, the electrical generation means may comprise an electromechanical generator, whereby a mechanism is provided which gives sufficient motion of a moveable coil linking a fixed magnetic field to produce said electrical energy. Furthermore, electrical energy may be generated using a number of photovoltaic cells located on top of the closure cap.

In use, the suitable electrical output voltage generated by whichever of the electrical generation means described herein is fed to signal conditioning circuitry which perform the steps of voltage reduction, charge storage and voltage regulation prior to detecting the biometric attributes of a user attempting to remove the cap, and operating the latching mechanism, if appropriate.

Various alterations and modifications may be made to the present invention without departing from the scope of the invention. For example, although particular embodiments refer to detecting the width of the thumb, forefinger and middle finger to gain access to the contents of the container, this is in no way intended to be limiting as, in use, access to the contents of the container is allowed by detecting any intrinsic biometric attribute of the hand or fingers of the user attempting to open the container. In particular, a proximity sensor may be provided to measure the distance between the top of the closure cap and the crotch of the hand. In use, the user places three fingers into recesses around the top of the cap (which can also be measured to validate finger size) and a proximity sensor then measures the distance of the hand crotch prior to opening the latching mechanism. Likewise, in a further alternative according to the present invention, a single index finger is placed into an aperture on top of the closure cap and a array of sensors inside the aperture determines the diameter of the finger using piezoelectric pressure transducers.

The invention claimed is:

1. A child resistant closure cap for a container, said cap comprising:

an electrical generation means for generating and storing electrical energy;

at least one sensing means, being energized by said electrical generation means, for detecting biometric attributes of a user attempting to remove said cap; and a latching means operable by said at least one sensing means, for releasably securing said child resistant closure cap to a container, in use.

2. A child resistant closure cap as claimed in claim 1, wherein said electrical generation means comprises a piezoelectric element.

3. A child resistant closure cap as claimed in claim 2, wherein said piezoelectric element is formed from a suitable piezoceramic material or polyvinylidene fluoride film.

4. A child resistant closure cap as claimed in claim 2, wherein said electrical generation means further comprises a ratchet-type mechanism for producing a repeatable dynamic force on said piezoelectric element.

5. A child resistant closure cap as claimed in claim 4, wherein said ratchet-type mechanism comprises a piezoelectric element located on a substrate or support plate which can turn freely within said child resistant closure cap.

6. A child resistant closure cap as claimed in claim 5, wherein said ratchet-type mechanism further comprises a knob mounted on top of said child resistant closure cap and rotating said knob causes said substrate or support plate to meet with a number of deflection nodules located at regular intervals inside a periphery of said cap, causing said support plate to be flexed and deformed repeatedly, which produces a large, regular dynamic force on said piezoelectric element.

7. A child resistant closure cap as claimed in claim 2, wherein said electrical generation means further comprises a flexible piezoelectric element mounted on a support plate, which is located inside said child resistant closure cap.

8. A child resistant closure cap as claimed in claim 7, wherein one end of said flexible piezoelectric element and support plate is fixed in one section of said cap and another end of said flexible piezoelectric element and support plate is fixed in a second movable section of said cap.

9. A child resistant closure cap as claimed in claim 8, wherein aligning both sections of said cap causes said flexible piezoelectric element to be flexed and distorted, which produces a large electrical output.

10. A child resistant closure cap as claimed in claim 2, wherein said electrical generation means further comprises a piezoelectric element interposed between two steel sections substantially formed as a flat circular disc.

11. A child resistant closure cap as claimed in claim 10, wherein said piezoelectric element and said steel sections are located on a number of support elements which are positioned at regular intervals inside a periphery of said child resistant closure cap.

12. A child resistant closure cap as claimed in claim 11, further comprising an axle with a nut located thereon situated above said circular disc and rotating said nut above said circular disc deflects said piezoelectric element and said steel sections, which generates a large electrical output.

13. A child resistant closure cap as claimed in claim 2, wherein said closure cap has an upper section, which is free to rotate above a fixed section, via an undulating contact surface.

14. A child resistant closure cap as claimed in claim 13, further comprising a substantially T-shaped member, which is connected to an inner periphery of said upper section of said cap, which is situated above said piezoelectric element interposed between two steel sections substantially formed as a flat circular disc.

15. A child resistant closure cap as claimed in claim 14, wherein rotating said upper section of said cap deflects said piezoelectric element and said steel sections via said T-shaped member, which generates a large electrical output.

16. A child resistant closure cap as claimed in claim 14, further comprising a resilient element interposed between said T-shaped element and said piezoelectric element.

17. A child resistant closure cap as claimed in claim 1, wherein said electrical generation means comprises an electromechanical generator.

18. A child resistant closure cap as claimed in claim 17, wherein said electromechanical generator comprises a coil linking a fixed magnetic field to produce electrical energy.

19. A child resistant closure cap as claimed in claim 1, wherein said electrical generation means further comprises a plurality of photovoltaic cells for converting light energy into electrical energy.

20. A child resistant closure cap as claimed in claim 1, wherein said electrical generation means comprises a self-winding mechanism, whereby releasing and replacing said cap provides a sufficient amount of electrical energy.

21. A child resistant closure cap as claimed in claim 1, wherein said at least one sensing means comprises at least one piezoelectric transducer, which performs both functions of detecting the biometric attributes of said user and, by doing so, also generates and stores electrical energy by virtue of the piezoelectric effect.

22. A child resistant closure cap as claimed in claim 21, wherein said at least one sensing means further comprises a number of sensors mounted on and around said child resistant closure cap for detecting the biometric attributes of a hand and fingers of the user attempting to remove said child resistant closure cap.

23. A child resistant closure cap as claimed in claim 1, wherein the biometric attributes comprise finger length, finger thickness or any human dimensions that change with age.

24. A child resistant closure cap as claimed in claim 21, wherein a physical position of said sensors is such that a child or other minor would not be able to position his hand and fingers on all of the sensors simultaneously to operate said latching means.

25. A child resistant closure cap as claimed in claim 1, wherein said at least one sensing means comprises at least one pressure transducer, which comprises at least one piezoelectric transducer.

26. A child resistant closure cap as claimed in claim 25, wherein said at least one piezoelectric transducer performs a function of said electrical generation means and is located on a same substrate as said electrical generation means.

27. A child resistant closure cap as claimed in claim 26, further comprising a substrate containing an array of piezoelectric transducers and a surface storage capacitor, which forms an integral biometric sensor and electrical generation means, and which could store and release sufficient electrical energy to operate said latching means.

28. A child resistant closure cap as claimed in claim 1, wherein said at least one sensing means may comprise at least one resistance, capacitance or conductivity sensor.

29. A child resistant closure cap as claimed in claim 1, wherein said at least one sensing means comprises a proximity sensor to determine a distance between a top of said cap and a hand crotch of the user.

30. A child resistant closure cap as claimed in claim 1, wherein said cap is adapted to engage with the container via a screw thread.

31. A child resistant closure cap as claimed in claim 1, wherein said cap is formed from polypropylene or molded from a suitable plastics material.

32. A child resistant closure cap as claimed in claim 1, wherein said cap has physical dimensions compatible with standard containers of pharmaceutical products, bleach or other products.

33. A child resistant closure cap as claimed in claim 1, wherein said latching means only allows user access to contents of the container after verification of the biometric attributes.

34. A child resistant closure cap as claimed in claim 1, wherein said latching means comprises a spring-loaded pin, which extends inwardly inside a periphery of said cap.

35. A child resistant closure cap as claimed in claim 34, wherein, in an unlocked position, said pin is retained inside said cap by an electromagnetic solenoid or a piezoelectric actuator.

36. A child resistant closure cap as claimed in claim 34, wherein, in a locked position, said pin extends outwardly into an aperture located in the container.

37. A child resistant closure cap as claimed in claim 34, wherein said latching means defines a 'fail-safe' position in absence of an electrical signal to an actuator, wherein said spring-loaded pin is forced in an aperture in said cap and said cap cannot be removed.

38. A child resistant closure cap as claimed in claim 1, wherein said latching means comprises a mechanism, which extends between an inner section and an outer sections of said cap.

39. A child resistant closure cap as claimed in claim 38, wherein, in a locked position, said mechanism is such that said outer section of said cap does not cooperate with said inner section of said cap, which is engaged with a screw thread of the container.

40. A child resistant closure cap as claimed in claim 38, wherein, in an unlocked position, said mechanism is such that said inner and outer sections of said cap cooperate and the user can unscrew said cap from the container.

41. A child resistant closure cap as claimed in claim 1, further comprising an audible sounder to warn that an unauthorized access by a child has been attempted.

42. A child resistant closure cap as claimed in claim 41, wherein said audible sounder comprises an electromagnetic or piezoelectric sounder.

43. A child resistant closure cap which, in use, is adapted to engage with a container, comprising:

at least one piezoelectric transducer for detecting biometric attributes of a user attempting to remove said child resistant cap from a container, and thereby generating an electrical output; and a latching means, being in connection with at least one piezoelectric transducer, for releasably securing said child resistant cap to the container.

44. A child resistant closure cap as claimed in claim 43, wherein said cap is adapted to engage with the container via a screw thread.

45. A child resistant closure cap as claimed in claim 43, wherein said cap is formed from polypropylene or molded from a suitable plastics material.

46. A child resistant closure cap as claimed in claim 43, wherein said cap has physical dimensions compatible with standard containers of pharmaceutical products, bleach or other products.

47. A child resistant closure cap as claimed in claim 43, wherein said latching means only allows user access to contents of the container after verification of the biometric attributes.

48. A child resistant closure cap as claimed in claim 43, wherein said latching means comprises a spring-loaded pin, which extends inwardly inside a periphery of said cap.

49. A child resistant closure cap as claimed in claim 48, wherein, in an unlocked position, said pin is retained inside said cap by an electromagnetic solenoid or a piezoelectric actuator.

50. A child resistant closure cap as claimed in claim 48, wherein, in a locked position, said pin extends outwardly into an aperture located in the container.

51. A child resistant closure cap as claimed in claim 48, wherein said latching means defines a 'fail-safe' position in absence of an electrical signal to an actuator, wherein said spring-loaded pin is forced in an aperture in said cap and said cap cannot be removed.

52. A child resistant closure cap as claimed in claim 43, wherein said latching means comprises a mechanism, which extends between an inner section and an outer section of said cap.

53. A child resistant closure cap as claimed in claim 52, wherein, in a locked position, said mechanism is such that said outer section of said cap does not cooperate with said inner section of said cap, which is engaged with a screw thread of the container.

54. A child resistant closure cap as claimed in claim 52, wherein, in an unlocked position, said mechanism is such that said inner and outer sections of said cap cooperate and the user can unscrew said cap from the container.

55. A child resistant closure cap as claimed in claim 43, further comprising an audible sounder to warn that an unauthorized access by a child has been attempted.

56. A child resistant closure cap as claimed in claim 55, wherein said audible sounder comprises an electromagnetic or piezoelectric sounder.

* * * * *